US010347979B1

(12) United States Patent
Boyle et al.

(10) Patent No.: US 10,347,979 B1
(45) Date of Patent: Jul. 9, 2019

(54) APPARATUS, METHOD, AND SYSTEM FOR RF-TRANSMISSIVE ACCESS PANELS FOR ELEVATED AND SHROUDED MOBILE NETWORK COMPONENTS

(71) Applicant: Musco Corporation, Oskaloosa, IA (US)

(72) Inventors: Timothy J. Boyle, Oskaloosa, IA (US); Kurt C. Herr, Jr., Centerville, IA (US); Gregory N. Kubbe, Ottumwa, IA (US); Andrew D. Mullen, Albia, IA (US); Nathanael J. Van Ee, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 336 days.

(21) Appl. No.: 15/372,914

(22) Filed: Dec. 8, 2016

Related U.S. Application Data

(60) Provisional application No. 62/269,606, filed on Dec. 18, 2015.

(51) Int. Cl.
*H01Q 1/42* (2006.01)
*H01Q 1/24* (2006.01)
*H01Q 1/12* (2006.01)

(52) U.S. Cl.
CPC ..... *H01Q 1/42* (2013.01); *H01Q 1/1228* (2013.01); *H01Q 1/246* (2013.01)

(58) Field of Classification Search
CPC ..... H01Q 1/42; H01Q 1/12; H01Q 1/24
USPC ..... 343/872
See application file for complete search history.

(56) References Cited

U.S. PATENT DOCUMENTS

| | | | |
|---|---|---|---|
| 2,531,183 | A | 11/1950 | Wisner |
| 2,579,139 | A | 12/1951 | Chipley |
| 3,435,124 | A | 3/1969 | Channell |
| D329,433 | S | 9/1992 | Wilson |
| D331,927 | S | 12/1992 | Birri |
| D333,661 | S | 3/1993 | Elliott et al. |
| D369,785 | S | 5/1996 | Cote |
| 5,651,606 | A | 7/1997 | Krogman |
| D383,138 | S | 9/1997 | Harada |
| D407,707 | S | 4/1999 | Jones |
| 5,964,522 | A | 10/1999 | Schaefer et al. |
| 5,988,833 | A | 11/1999 | Giese et al. |

(Continued)

OTHER PUBLICATIONS

COMMSCOPE 4G and LTE Solutions for Mounting Catalog.

(Continued)

*Primary Examiner* — Andrea Lindgren Baltzell
(74) *Attorney, Agent, or Firm* — Jessica R. Boer

(57) ABSTRACT

Disclosed herein is a mobile network concealment system or assembly which provides for aesthetic modification without impairing, diminishing, or otherwise affecting radio frequency (RF) transmission/reception. Said mobile network concealment system or assembly improves accessibility to encased mobile network devices well after installation in a manner such that (i) materials can be tailored, colored, molded, or otherwise formed or manipulated to be aesthetically pleasing, and (ii) a technician has the ability to remove, alter, or otherwise modify or access the devices in a way that allows the technician to service or troubleshoot the mobile network devices in situ (i.e., without removing the concealment system).

15 Claims, 18 Drawing Sheets

(56) References Cited

U.S. PATENT DOCUMENTS

| | | | | |
|---|---|---|---|---|
| 6,160,703 | A | 12/2000 | Lopez | |
| 6,586,671 | B1 | 7/2003 | Kelley et al. | |
| D486,146 | S | 2/2004 | Dearnley | |
| D595,700 | S | 7/2009 | Cook et al. | |
| 7,765,770 | B2 | 8/2010 | Fournier | |
| 7,874,126 | B2 | 1/2011 | Fournier | |
| 8,203,501 | B2 | 6/2012 | Kim | |
| D666,583 | S | 9/2012 | Le et al. | |
| 2010/0026604 | A1* | 2/2010 | Caldwell | H01Q 1/1242 343/890 |
| 2014/0266943 | A1 | 9/2014 | Thomson et al. | |

OTHER PUBLICATIONS

COMMSCOPE Assembly Drawing, Concealed Radome, 2 Rad 9 RRU OVP, SSC-760215913, Sep. 1, 2015.
COMMSCOPE Assembly Drawing, Concealed Monopole, 2 RAD 9 RRU OVP 100FT AGL, SSC-760215913-100, Sep. 1, 2015.

* cited by examiner

Detail A

Detail B

View C - C

APPARATUS, METHOD, AND SYSTEM FOR RF-TRANSMISSIVE ACCESS PANELS FOR ELEVATED AND SHROUDED MOBILE NETWORK COMPONENTS

CROSS-REFERENCE TO RELATED APPLICATIONS

This application claims priority under 35 U.S.C. § 119 to provisional U.S. application Ser. No. 62/269,606, filed Dec. 18, 2015, hereby incorporated by reference in its entirety.

I. BACKGROUND OF THE INVENTION

The present invention generally relates to mobile network devices or components which are elevated many feet (e.g., 30-100+ feet) in the air and covered, shrouded, or otherwise encased in an aesthetic or protective cover. In at least some cases, said aesthetic or protective cover is sized or shaped to reduce wind loading (i.e., minimize the effect of wind on the cover). More specifically, the present invention relates to improving accessibility to encased mobile network devices in a manner that does not impede their functionality (e.g., does not block or impair signal transmission or reception); namely, via strategically placed RF-transmissive windows which form part of said aesthetic or protective cover.

It is well known that cellular service providers and wireless internet providers (hereinafter referred to both generically and collectively as mobile network service providers) have a number of components or devices (e.g., radios, antennas, filters) that are required to maintain a mobile network. Each mobile network device—as they are generically referred to herein—has its own requirements for correct operation, but all typically require (i) precise, elevated positioning relative a pole or other structure; (ii) wiring, bracketry, or other components which are necessary for functioning but are not aesthetically pleasing; and (iii) access by a technician even after installation (e.g., for troubleshooting signal issues).

Consider, for example, a mobile network in which a mobile phone operates. A mobile network service provider will typically have a number of geographically dispersed base stations to which a mobile phone may communicate via air link. Each base station typically includes a number of transceivers (often installed in a ground-mounted cabinet or other enclosure), a number of antennas or radios (often spaced equidistantly about the perimeter of some feature at the top of a tower or pole), and some form of communication line (e.g., coaxial cable, fiber optic) running from the transceivers to the antennas and/or radios. To ensure adequate signal propagation and coverage (e.g., to build the "mesh" of a network), said antennas typically comprise (a) one or more omnidirectional antennas which require high (e.g., the aforementioned 30-100+ feet), relatively unencumbered mounting; (b) one or more flat panel antennas which require high mounting and relatively precise aiming (e.g., within 1-3° of a desired direction); or a combination of (a) and (b). Particularly for the flat panel antennas, the precise aiming requirement often results in several man-hours at installation (e.g., aiming, re-aiming, checking the signal strength, adjusting mounting height to avoid interference with local geography), as well as potentially several man-hours after installation (e.g., re-aiming, field servicing, troubleshooting signal issues, adding devices).

The aforementioned mobile phone network will also typically include a mobile switch (e.g., to track SIM information, connect to toll stations for land line calls, etc.) and some kind of backhaul communication between each base station and the mobile switch. In some instances the backhaul may comprise a hard line (e.g., fiber optic); in other instances, microwave devices may also need to be installed at or near the top of the aforementioned tower or pole for wireless communications to the mobile switch. The microwave devices often require line-of-sight with other microwave devices on other poles (which may or may not be at a high mounting height as previously defined, but are typically out-of-human-reach (e.g., 10+ feet))—thereby creating a "chain" of communication rather than the aforementioned "mesh" associated with the antennas. Said microwave devices also require very precise aiming (e.g., less than 1° deviation from a desired direction) to ensure point-to-point communications along the backhaul. This requires a great deal of involvement from a technician who must often complete fine tune adjustments to alignment while elevated many feet in the air—and potentially exposed to high winds or other adverse environmental conditions (e.g., rain). The same may be required of a technician multiple times during the life of the mobile network (e.g., to add chains, re-aim devices, etc.).

The above example is a simplification of a very complex system—and ignores any specialty devices such as filters which may be required to prevent interference with wireless communications from other industries (e.g., aeronautics) or to prevent interference from frequency re-use—but it illustrates the labor-intensive process of creating, installing, and maintaining a mobile network, and is background for the discussion to come.

Often, mobile network service providers partner with end users or other non-related entities to select sites to erect towers, poles, or other elevating structures; zoning, construction, and material cost are often substantially resolved issues, and so there is a benefit to doing so. A city may work with a mobile network service provider to erect poles on rooftops (the tradeoff for the investment being a stronger signal in town), a farmer may permit a mobile network service provider access to a portion of field (the tradeoff being increased revenue per acre), or the like. This is a common practice in the industry and has led to many synergistic relationships; though, these relationships are not without tension.

Often during evaluation of a potential partnership between a mobile network service provider and an end user/non-related entity the issue of aesthetics is raised. It is not uncommon for urban development in any community to include consideration of how industry (any industry) impacts the community aesthetic—an aesthetic that may differ from community to community, but in any event does not typically show a preference for exposed mobile network devices and wiring to a ground-mounted cabinet (which often must be surrounded by a fence for safety or theft deterrence). In many situations the end user or non-related entity will look for ways to camouflage or hide mobile network devices so they do not disrupt any desired aesthetic. While such mobile network concealment assemblies or systems—as they will be called herein—do exist and have advanced over the years, such efforts have focused so exclusively on the aesthetics that access to the mobile network devices has been largely ignored. There are several examples of cellular towers made to look like trees or cacti or the like, but these methods of concealment do not typically permit access by a technician to the mobile network devices contained therein, or if they do, do not permit access to the extent that devices can be re-aimed, re-wired, added, removed, or the like as may be required from time to time to ensure the functionality or integrity of a mobile network. In essence, in the pursuit of aesthetics, an already labor-intensive and timely process of maintaining a mobile network has in many instances become more so.

Thus, there is room for improvement in the art.

II. SUMMARY OF THE INVENTION

Mobile network service providers often partner with end users or unrelated entities to access preexisting structures or sites to which their mobile network devices can be added; the end user/unrelated entities gain the benefit of boosted signal strength, and the service provider gains a stronger network. Often these partnerships are in tension because the mobile network service providers require lines-of-sight, high mounting to prevent signal interference, secure ground mounting of components, or the like—and these needs often result in a negative aesthetic from the perspective of the end user/unrelated entity (particularly in communities with preserved historical or cultural value). State-of-the-art mobile network concealment systems have sought to address this issue of negative aesthetic by camouflaging mobile network devices—see, for example, any of the custom products available from Larson Camouflage, Tuscon, Ariz., USA—yet for many producers doing so impedes access to said devices. Specifically, many state-of-the-art mobile concealment systems do not permit at-will access to mobile devices contained therein. Even those state-of-the-art mobile concealment systems which do have some form of a technician access panel do not typically have the internal space available to permit practical re-aiming, re-wiring, adding, or removing mobile network devices (as may be necessitated from time to time in a mobile network). Even those few state-of-the-art mobile concealment systems which may have some removable panels and/or limited internal cavities or space in which a technician may service devices are limited insomuch that they are permanent installations—e.g., lines-of-sight are set and not adjustable (even if it is desirable). It is for at least these reasons that the tension in an otherwise beneficial partnership endures.

It is therefore a principle object, feature, advantage, or aspect of the present invention to improve over the state of the art and/or address problems, issues, or deficiencies in the art.

Envisioned herein are apparatus and methods by which mobile network concealment is provided for mobile network devices elevated many feet above the ground, and in a manner that provides access to said mobile network devices during and after installation. The envisioned mobile network concealment assembly is adjustable insomuch that if mobile network devices are added, removed, or re-aimed in a manner as to completely shift elevating positions or lines-of-sight, radio frequency (RF)-transmissive portions of said mobile network concealment assembly can be shifted in kind so that signal transmission and reception is preserved. According to at least some embodiments, entire panels of the envisioned mobile network concealment assembly could be switched out so to accommodate the adding, removing, or re-aiming of mobile network devices over the life of the mobile network.

Further objects, features, advantages, or aspects of the present invention may include one or more of the following as it applies to the envisioned mobile network concealment assembly, apparatus, or methods:

a. provides rigidity or structural integrity; and b. provides one or more surfaces for aesthetic modification.

These and other objects, features, advantages, or aspects of the present invention will become more apparent with reference to the accompanying specification and claims.

III. BRIEF DESCRIPTION OF THE DRAWINGS

From time-to-time in this description reference will be taken to the drawings which are identified by figure number and are summarized below.

Figure 4A:
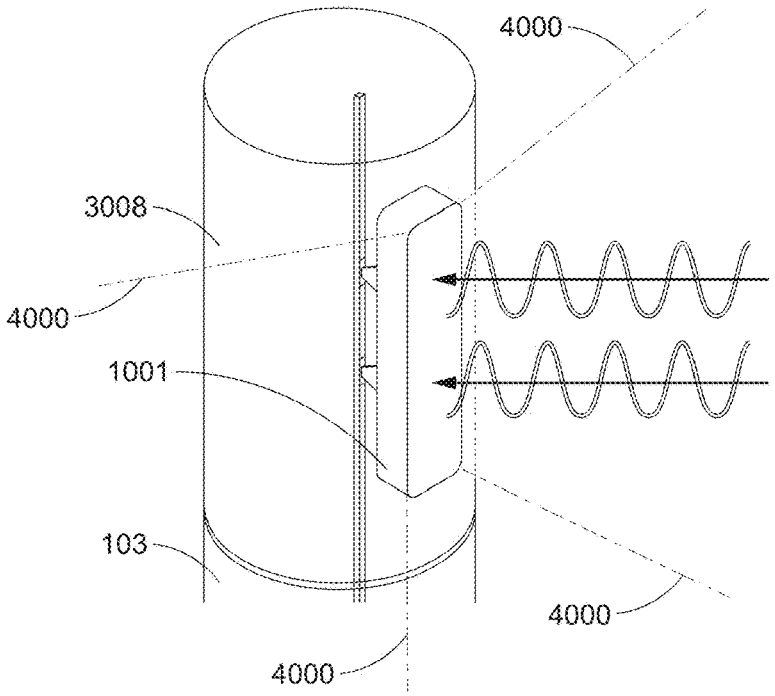
Figure 4B:
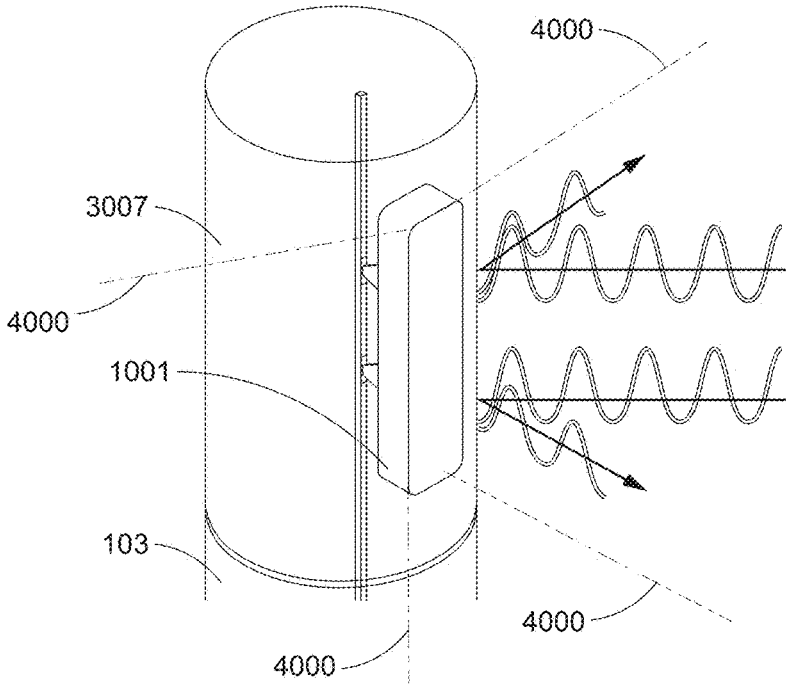
Figure 4C:
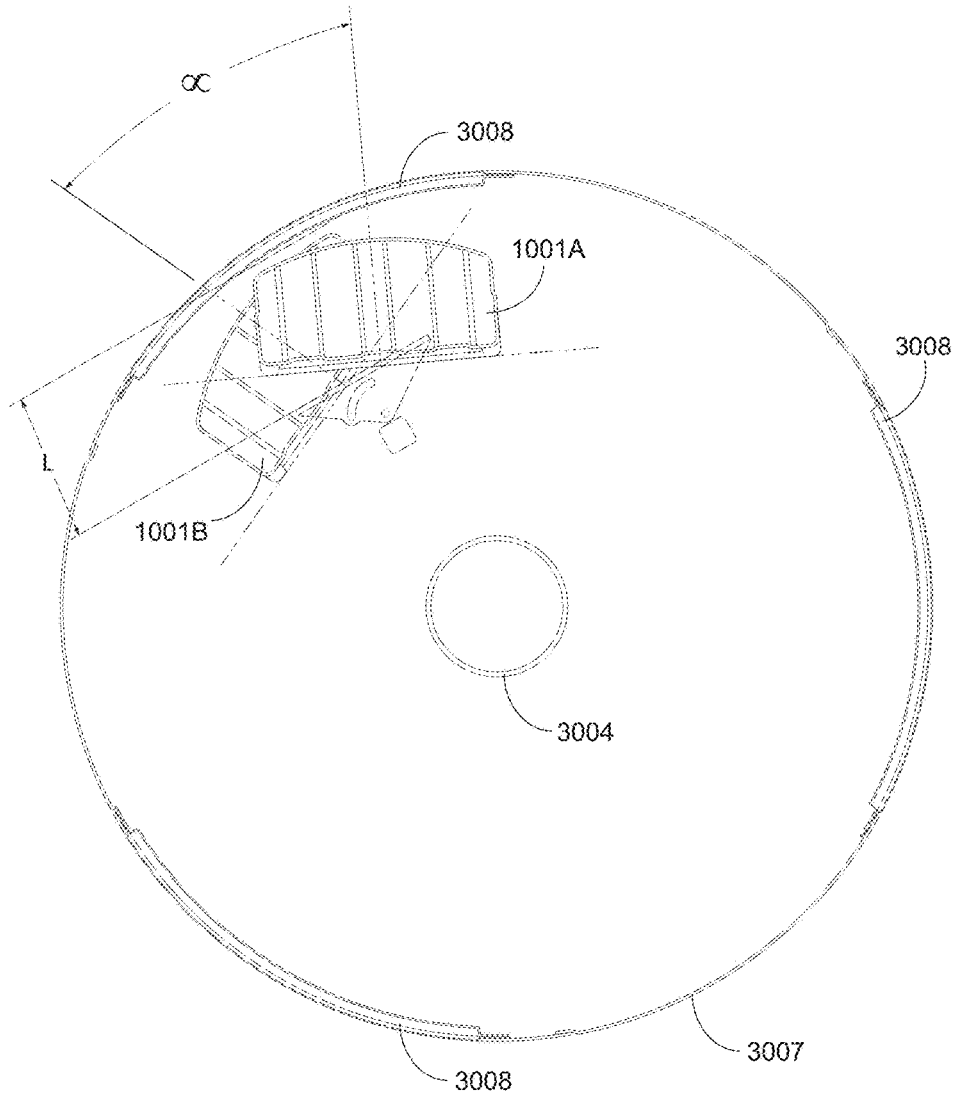

FIGS. 4A and B diagrammatically illustrate via perspective view transmission of an RF signal when an RF-transmissive material is in the signal path (a) and in an alternative where a material not RF-transmissive or not RF-transmissive to the needed degree is in the signal path (b). FIG. 4C illustrates an alternative view (here a top view) which diagrammatically illustrates a typical angle over which the RF signal of FIGS. 4A and B is expected to be transmitted according to aspects of the present invention.

Figure 5:
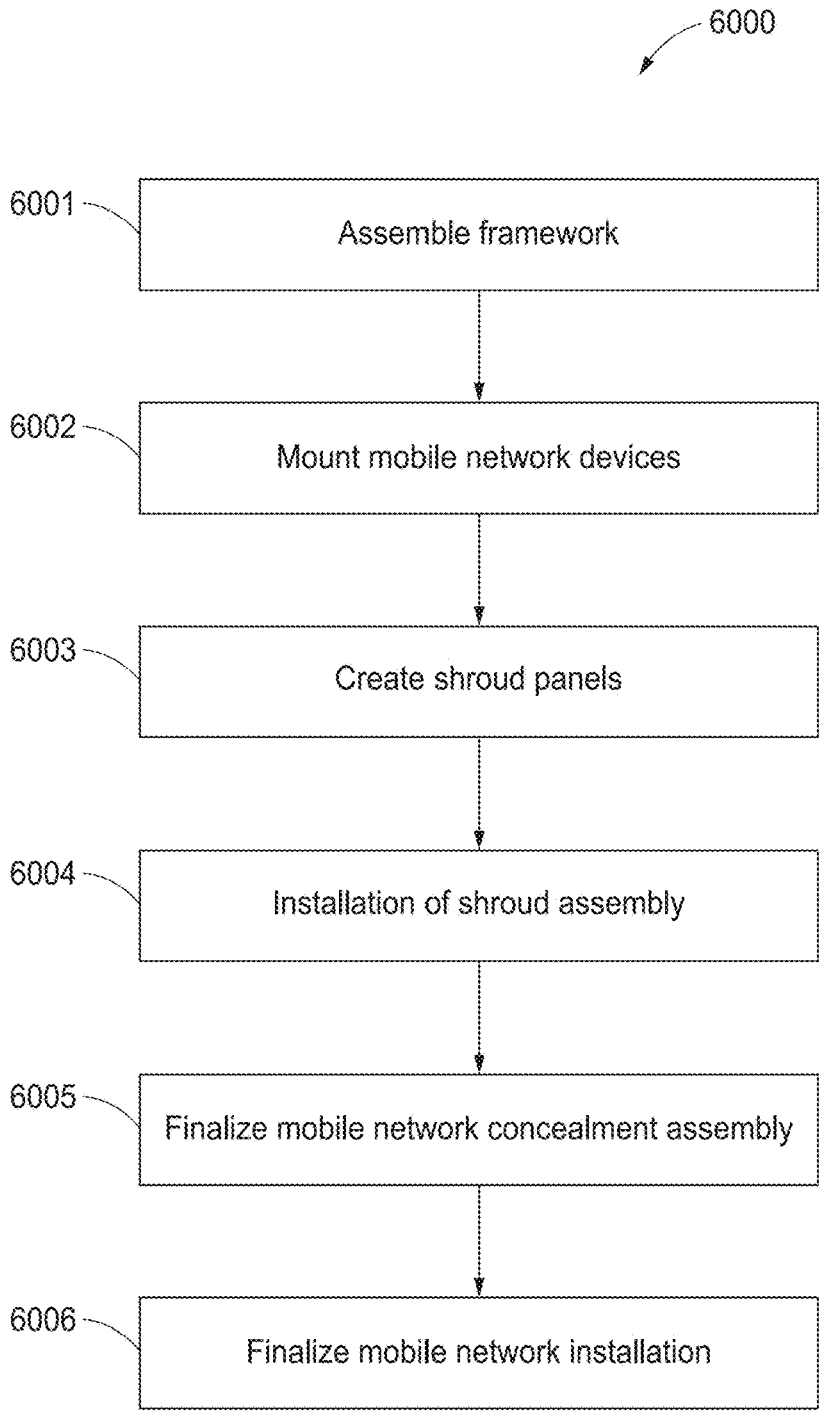

FIG. 5 illustrates one possible method of installing a mobile network concealment assembly according to aspects of the present invention.

Figure 3A:
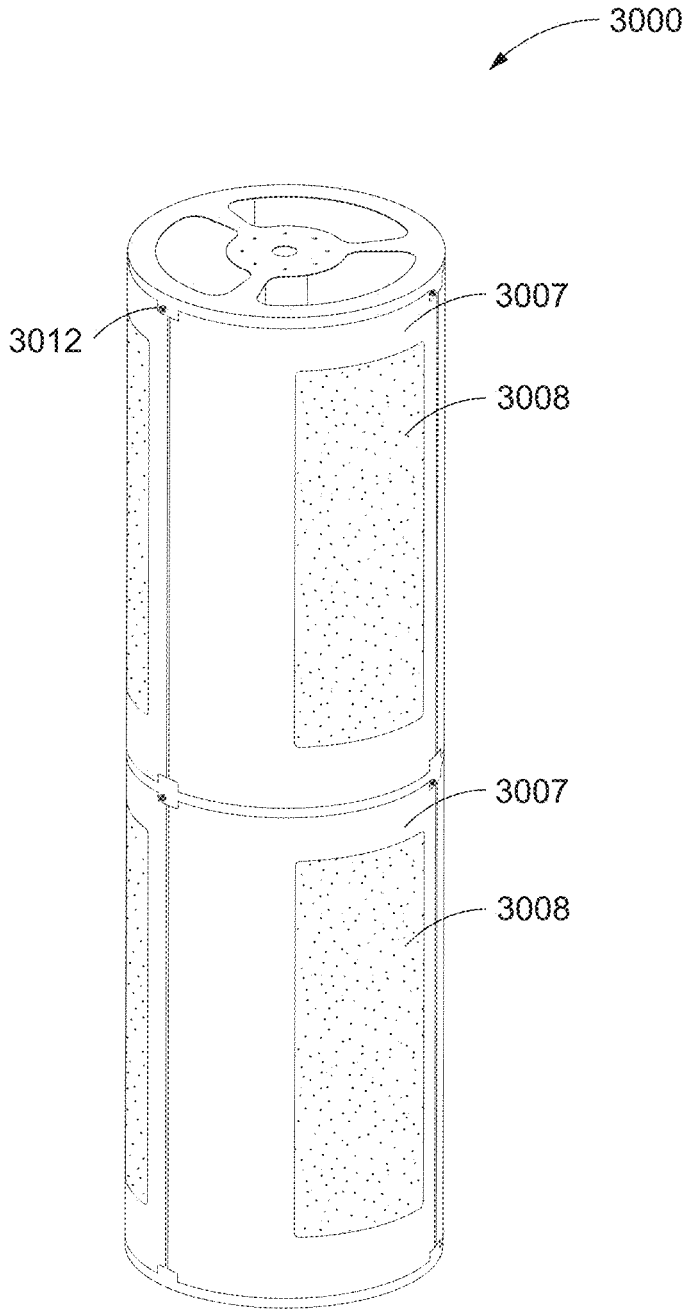
FIG. 3A illustrates the canister-shaped, multi-panel shroud and framework of FIGS. 1A-2B, enlarged and in isolation.
Figure 6A:
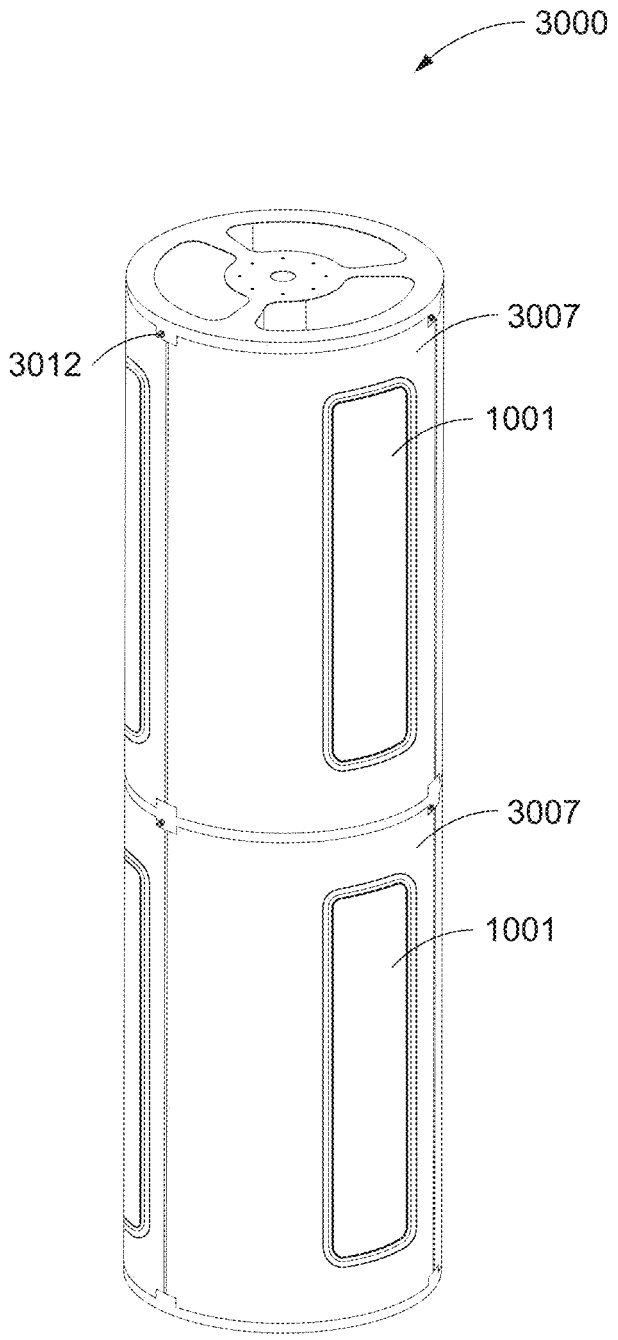

FIG. 6A illustrates an alternative to the shroud of FIG. 3A according to aspects of the present invention.

Figure 6B:
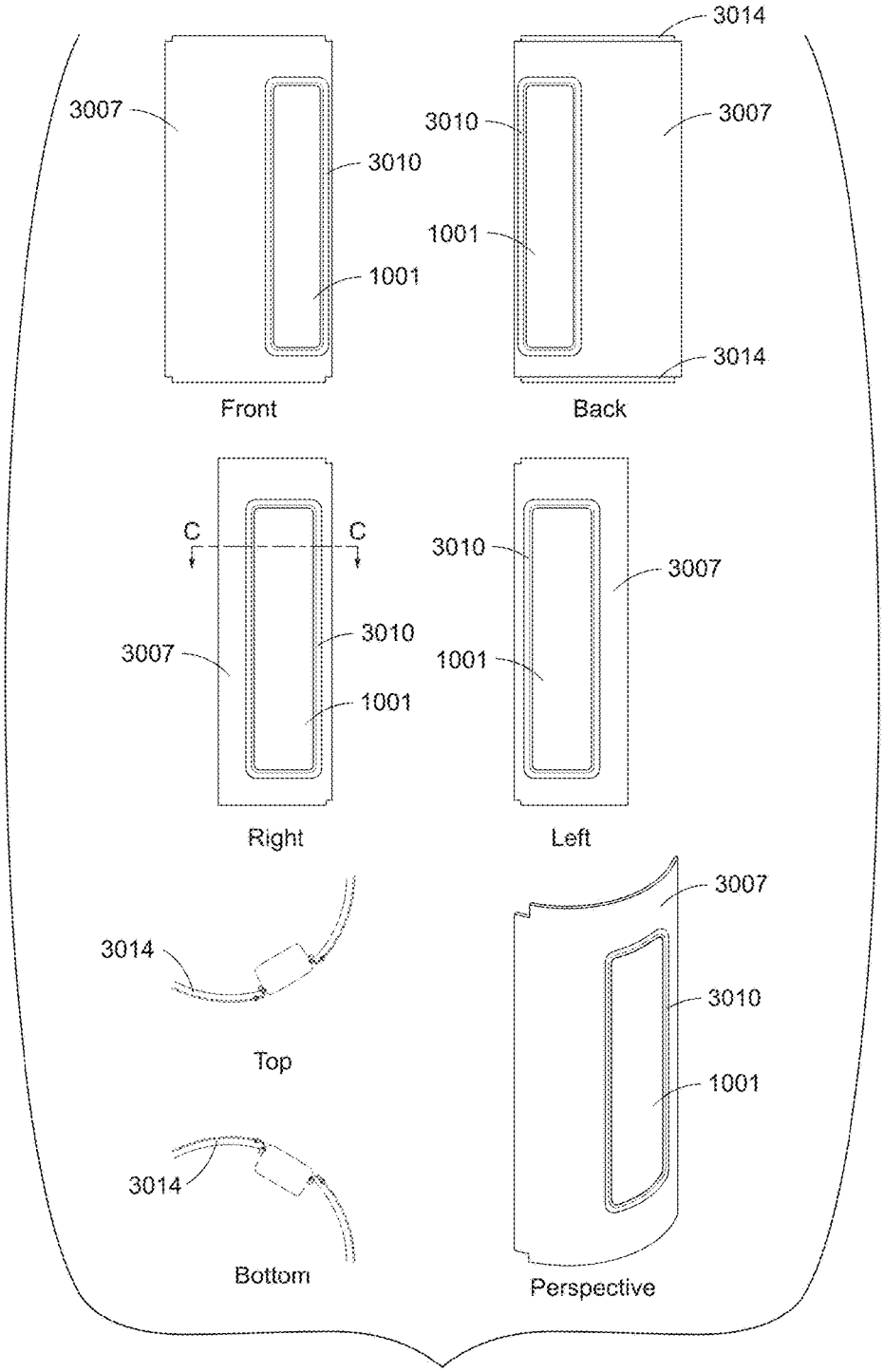

FIG. 6B illustrates in isolation various views of one panel of the alternative shroud of FIG. 6A with associated brace.

Figure 6C:
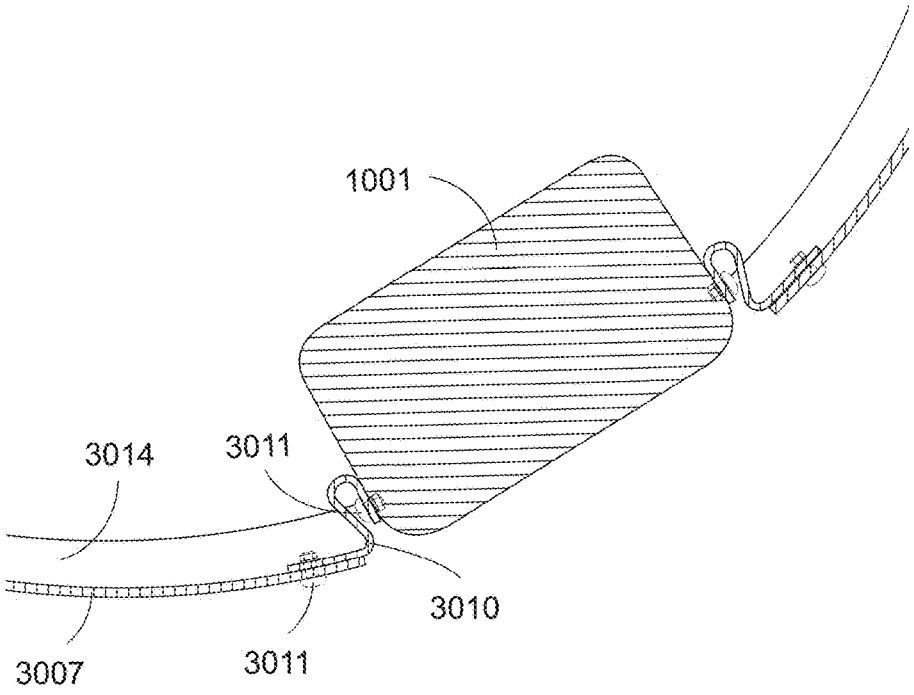

FIG. 6C illustrates a section view taken along view line C-C of FIG. 6B.

Figure 7:
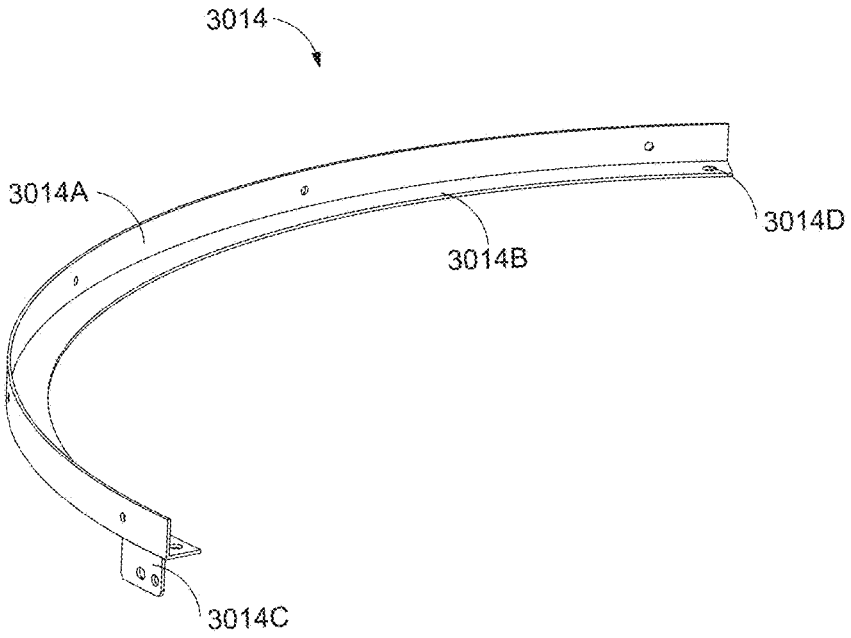

FIG. 7 illustrates the brace component of the mobile network concealment assembly, enlarged and in isolation.

IV. DETAILED DESCRIPTION OF EXEMPLARY EMBODIMENTS

A. Overview

To further an understanding of the present invention, specific exemplary embodiments according to the present invention will be described in detail. Frequent mention will be made in this description to the drawings. Reference numbers will be used to indicate certain parts in the drawings. Unless otherwise stated, the same reference numbers will be used to indicate the same parts throughout the drawings.

Regarding terminology, reference is given herein to a "cover", "covered", "shroud", "shrouded", "concealing", "conceals", "canister", "window", "frame", "boot", "encasement", and "encased"—these terms all refer to either the functionality of the envisioned mobile network concealment assembly, or the device/assembly itself, and are used merely for convenience or in a descriptive sense for a particular embodiment or scenario. None of these terms should be given any weight beyond the common meaning given herein, and none of these terms should be considered limiting as to the form or function of the envisioned mobile network concealment assembly, apparatus, or methods.

Further regarding terminology, reference is given herein to "radio frequency", "radio frequencies", "RF", "transmission", "reception", "electromagnetic", "EM", and "signal"—these terms all refer to either a mode of wireless communication or the wireless communication itself, and are generically depicted by waves and arrows in FIG. 4A and B. While specific examples of mobile network devices are presented herein, it should be noted that aspects according to the present invention are not limited to any particular type of mobile network, mode of communication, bandwidth, frequency, type of electromagnetic (EM) signal, or the like. Likewise, illustration of signal waves in FIGS. 4A and B is not intended to be indicative of any particular type of signal, frequency, or the like, and in the case of FIG. 4B, is not necessarily representative of how a signal may be deflected, modified, or absorbed in reality.

Still further regarding terminology, reference is given herein to "end user(s)", "non-related entities", and "unrelated entities"—these terms all refer to one or more individuals who may partner with mobile network service providers to produce an assembly of shrouded mobile network components such as is described herein. While there are a number of benefits from said one or more individuals partnering with said mobile network service providers, it should be noted that aspects of the present invention are not limited to such a partnership. A mobile network service provider could practice many, if not all, aspects of the present invention and reap many benefits stated herein—without partnering with any other entity, for example.

Lastly, it should be noted that mobile network service providers operate in a variety of terrains, in a variety of locations, on proprietary bandwidths, with specialty equipment suited to support their particular network—and that a precise knowledge of the details of their devices, installation sites, mounting locations, mounting heights, and the like is not needed to understand or make use of aspects according to the present invention; this is likewise true for any potential aesthetic that an end user could devise. While particular examples of mobile network assemblies are set forth, the invention is in no way limited to the aesthetic the figures described herein may evoke, nor is the invention supporting any particular approach to mobile network design.

The exemplary embodiments envision apparatus and methods by which mobile network devices or assemblies of mobile network devices of varying composition, design, and structure may be shrouded or otherwise encased in a cover. One or more panels of said cover work together with other envisioned components to comprise a mobile network concealment assembly that provides, at least in some embodiments, structural integrity (e.g., so to protect against wind or other weather conditions when elevated in the air) and pleasing aesthetics (e.g., so to leave undisturbed urban design or existing aesthetics of the elevating structure and/or other components). Specific methods of assembling and accessing said mobile network concealment assembly are discussed (e.g., so a technician or other person may access the mobile network devices or assemblies in situ (i.e., from the elevated position) during and after installation).

B. Exemplary Method and Apparatus Embodiment 1

Figure 1A:
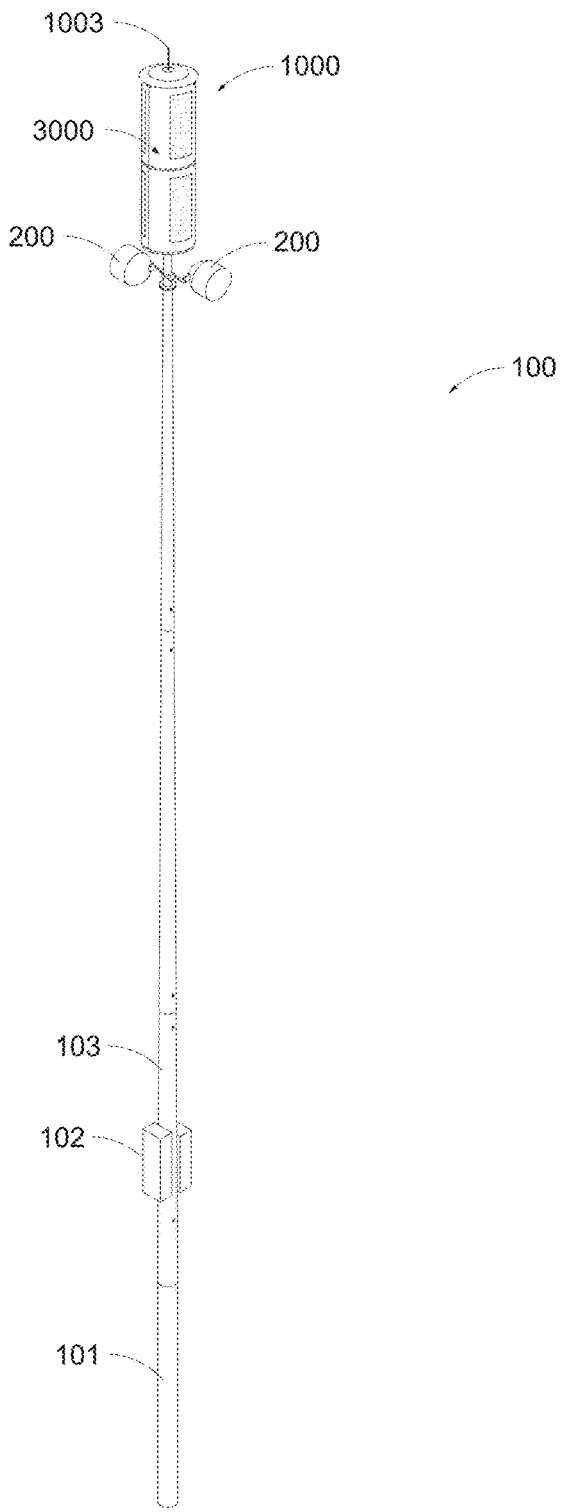
FIG. 1A illustrates a perspective view of a pole having one or more mobile network devices and a shroud according to at least one aspect of the present invention.
Figure 1B:
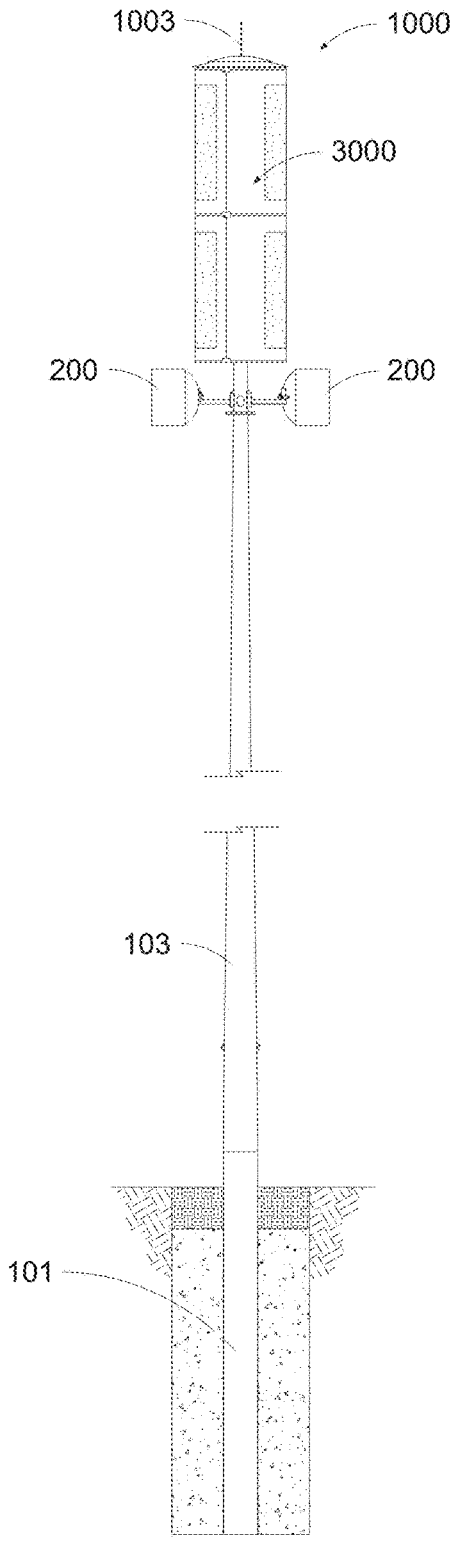
FIG. 1B illustrates an enlarged, partial front view of FIG. 1A as installed at a site.
Figure 1C:
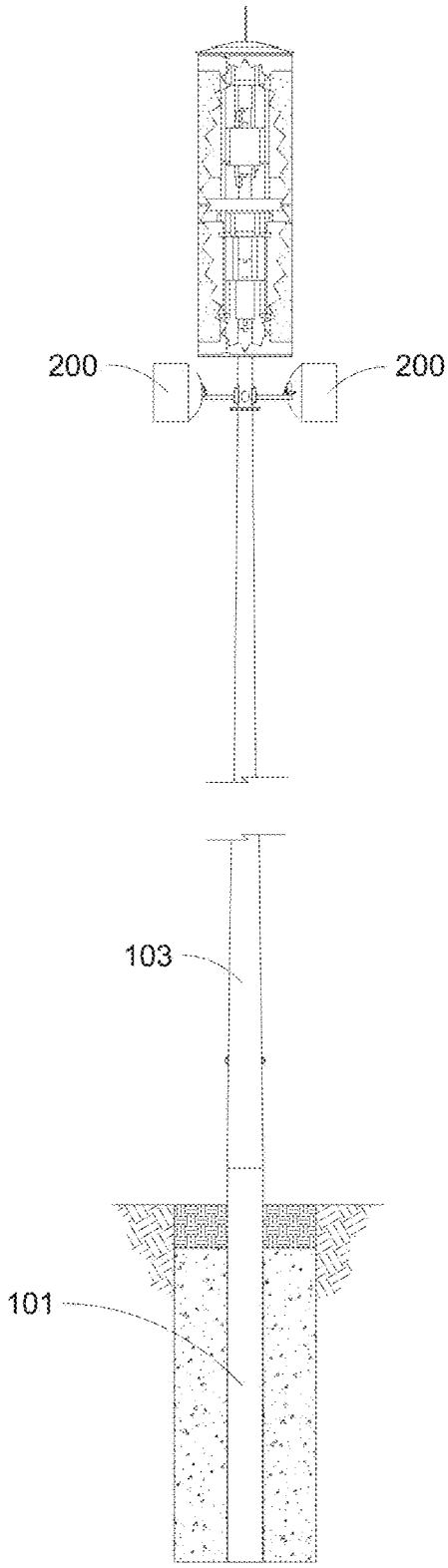
FIG. 1C illustrates the enlarged, partial front view of FIG. 1B with internal components partially revealed via cutaway of the aforementioned shroud; for clarity, all fastening devices and holes associated with the framework have been removed.

FIGS. 1A-C illustrate a mobile network installation 100; here comprising a pole assembly and mobile network concealment assembly 1000 which includes a multi-panel, canister-type shroud assembly 3000 and one or more mobile network devices. With respect to the pole assembly of FIG. 1A, mobile network installation 100 more specifically includes a lower pole or base section 101 which is at least partially installed below ground (see FIGS. 1B and 1C), one or more enclosures 102 to house electronics, and one or more slip-fit pole sections 103. In practice, the precise design and function of parts 101, 102, and 103 may differ, e.g., depending on the nature of the aforementioned end users or unrelated entities which provide preexisting structures. For example, if the end user/unrelated entity is a lighting company, part 101 may be hollow (e.g., to allow the internal routing of wiring) and electrically grounded (see, e.g., U.S. Pat. No. 8,742,254 incorporated by reference herein in its entirety), part 102 may include wiring or functionality for both mobile network devices and lighting equipment (see, e.g., U.S. Pat. No. 7,059,572 incorporated by reference herein in its entirety), and part 103 may include either several slip-fit sections or be a single, elongated pole such as are known in the art. The design of parts 101, 102, and 103 could even benefit the partnership between the mobile network service provider and the end user/unrelated entity insomuch that aesthetics could be addressed. For example, in the above scenario enclosure 102 could potentially replace the aforementioned fenced-in, ground-mounted cabinet mobile network service providers typically require and which typically do not fit with a desired aesthetic. As an added benefit, lighting system enclosures are typically elevated at least 10 feet above the ground (i.e., out-of-human-reach)—which adds a measure of protection against theft, vandalism, and other concerns with the aforementioned ground-mounted cabinets.

FIGS. 1B and C illustrate in greater detail the components of mobile network concealment assembly 1000; here, located near the distal end of mobile network installation 100 generally opposite part 101, though this could differ and not deviate from at least some aspects according to the present invention. FIGS. 1B and C illustrate some mobile network devices—in this case, microwave antennas 200—affixed to pole sections 103 yet not shrouded, and some mobile network devices—in this case directional cellular antennas 1001 and cellular radios 1002 (see also FIGS. 2A and B)—as encased in shroud assembly 3000. In practice, some mobile network devices could be concealed whereas others are not, or all mobile network devices could be concealed. Mobile network devices could be removably clamped to a pole section, or could be a part of a premade assembly which is slip-fit or otherwise affixed to a pole section. For example, FIGS. 2A and B illustrate a pre-assembled grouping of mobile network devices 1001 and 1002 bolted or otherwise affixed to supports 3005 which are further bolted or otherwise affixed to a main support (i.e., the backbone—also later discussed). Looking at FIG. 2B it can be seen that in the present embodiment there are two pre-aimed, pre-assembled groupings of mobile network devices; one stacked on the other. A first pre-aimed/pre-assembled grouping of radios 1002 and directional antennas 1001 (nearest lightning rod 1003) is affixed to supports 3005 which are elongated along the same axis as that of the pole itself. This first assembly of mobile network devices occupies the vertical space between upper rib 3001 and middle rib 3003, the mobile network devices horizontally spaced more or less equidistantly about the perimeter of the main support; here, a backbone 3004 (which is conceptually an extension of the pole) which spans the full length of mobile network concealment assembly 1000 and terminates at a plate assembly 201. The first assembly of mobile network devices is bracketed, bolted, welded, or otherwise affixed to backbone 3004 at the desired position in both the vertical and horizontal space which is dependent upon a number of factors (e.g., local geography, type of signal, network layout of the provider, etc.) but in any event is coordinated with the positioning of RF-transmissive panels 3008 (see Figure 2A). Apparatus and methods could be removable (e.g., clamping), if desired; this could be beneficial in re-positioning, re-aiming, or removing mobile network devices. Alternatively, apparatus and methods could be permanent (e.g., welding); this could be beneficial in providing rigidity and stability. Both removable and permanent apparatus and methods could be used with respect to mobile network concealment assembly 1000.

A second pre-aimed/pre-assembled grouping of radios 1002 and antennas 1001 (nearest plate assembly 201, FIGS. 2A and B) occupies the vertical space between middle rib 3003 and lower rib 3002 and, like the first assembly, is more or less equidistantly spaced about the main support (i.e., backbone 3004) in the horizontal space. The second assembly of mobile network devices is bracketed, bolted, welded, or otherwise affixed to backbone 3004 at the desired position in both the vertical and horizontal space in generally the same manner at the first assembly, though as stated, one assembly could be bracketed whereas the other could be welded, if desired.

Figure 2A:
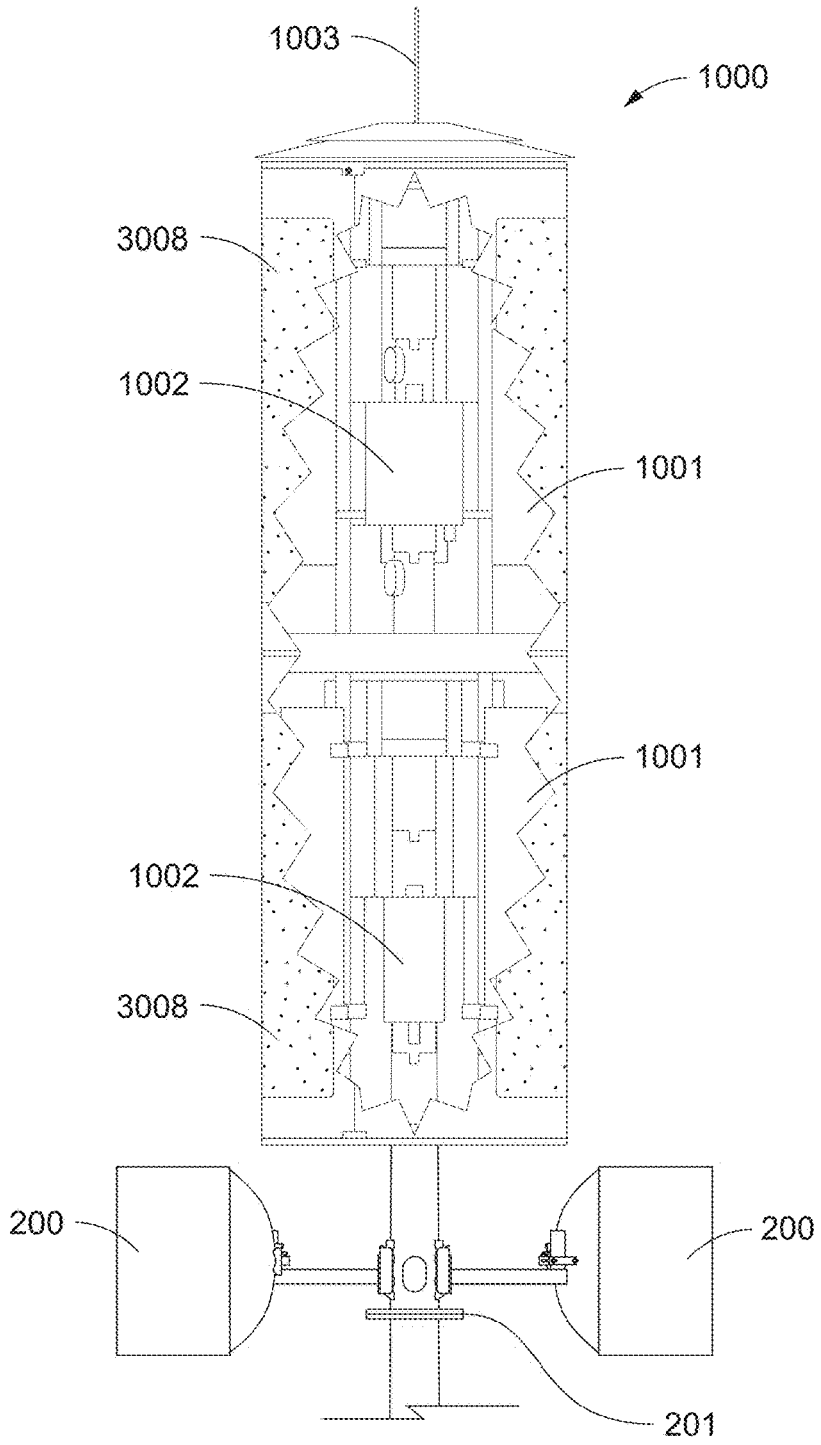
FIG. 2A illustrates a still further enlarged, partial front view of FIG. 1C illustrating aspects according to the present invention.
Figure 2B:
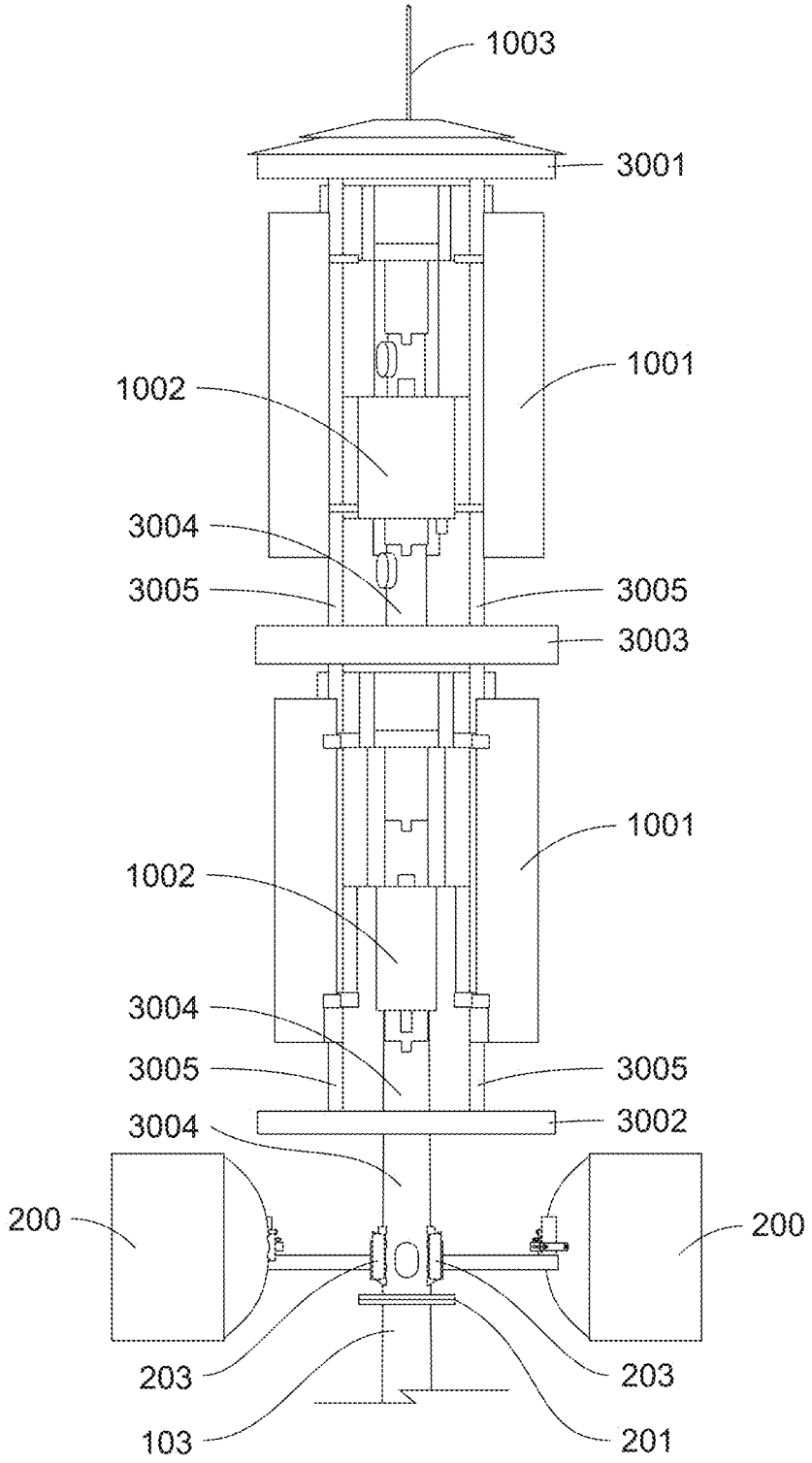
FIG. 2B illustrates the still further enlarged, partial front view of FIG. 2A with the shroud completely removed.
Figure 3B:
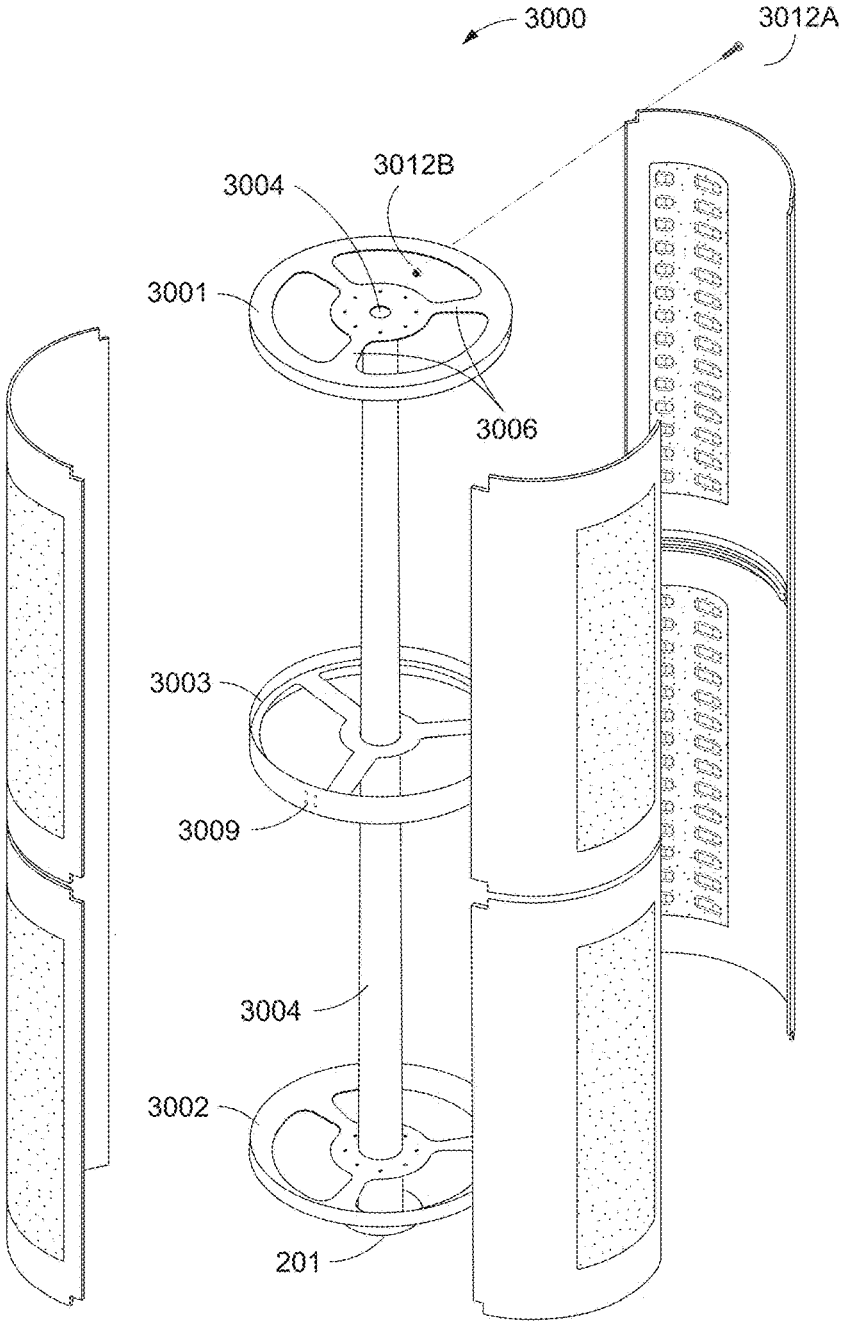
FIG. 3B illustrates a partially exploded view of the canister-shaped, multi-panel shroud and framework of FIG. 3A; note that for clarity, only one set of fastening devices (3012A/3012B) and one set of hinge holes (3009) are illustrated.

There is both flexibility and benefit in this approach to mounting mobile network devices. For example, if an entire assembly of devices can be pre-aimed and pre-assembled, onsite installation time is reduced—even if some fine tuning is required, a technician does not have to fully aim all devices in situ. If supports 3005 are bracketed to backbone 3004 instead of welded, entire sub-assemblies of devices could be removed or replaced as needed (e.g., because of component failure) without having to disturb the rest of the mobile network devices. If desired, individual devices could be removably clamped to backbone 3004 so to facilitate rapid removal; this is illustrated in FIGS. 2A and B for microwave antennas 200 (i.e., via state-of-the-art clamping or bracketing device 203). In this specific example, bracket 203 is welded to backbone 3004, but the clamping end (i.e., the end opposite the end abutting backbone 3004) allows a mobile network device to be removed at will. Other techniques of attachment are possible; for example, devices or supports 3005 could be suspended from spokes 3006 (FIG. 3B) which connect the ribs to the backbone, or even held in compression between spokes 3006 of rib 3001 and spokes 3006 of rib 3003 (or held in compression between spokes 3006 of rib 3003 and spokes 3006 of rib 3002). An entire mobile network concealment assembly 1000 could be removed or rotated in situ; this could be achieved by removing fastening devices from plate assembly 201—which generally comprises (i) a plate attached to backbone 3004 having one or more apertures, (ii) a complementary plate attached to distalmost pole section 103 having one or more apertures, (iii) removable fastening devices, and may be similar to described in U.S. patent application Ser. No. 15/260,464, issued as U.S. Pat. No. 10,199,712 on Feb. 5, 2019, and incorporated by reference herein in its entirety—and either switching out mobile network concealment assembly 1000 for another (e.g., if a different aesthetic or shape of shroud is desirable) or rotating mobile network concealment assembly 1000 (e.g., if aiming directions have changed), then re-securing the fastening devices of plate assembly 201. Alternatively, instead of a plate assembly 201—which produces a state-of-the-art flange-type joint—backbone 3004 of mobile network concealment assembly 1000 could be substantially hollow and slip-fit over distalmost pole section 103. If said pole section was also substantially hollow, it would provide an opportunity to route wiring from the elevated mobile network devices in a discrete and aesthetically pleasing manner down the length of the pole to be terminated at enclosure 102 (or elsewhere)—again potentially benefitting the partnership between the mobile network service provider and the end user/unrelated entity.

FIGS. 3A-F illustrate in greater detail the shroud of mobile network concealment assembly 1000 according to Embodiment 1. As can be seen from FIGS. 3A-C, shroud assembly 3000 includes two stacked sets of panels (each set having three complementary panels) which are removably affixed to ribs 3001, 3002, and 3003 (via a brace 3014, see FIG. 7) such that they encapsulate the two stacked sets of pre-aimed, pre-assembled mobile network devices already discussed. In this particular configuration each panel in a set has a curvature spanning 120° such that three panels (i.e., one set) work together to cover an entire diameter (i.e., 360°); this is perhaps best illustrated with respect to FIG. 3B where, for clarity, all mobile network devices have been removed from the view. As can be seen, two panels (one stacked on the other) are exploded off the framework (i.e., the combination of ribs and backbone with other structural components) at 120° intervals. As envisioned, each panel is hinged (via a hinge assembly 3006, see FIG. 3D) such that each panel in a set can be opened and swung away much like a door—in situ—during and after installation so to facilitate access to the mobile network devices encased thereby. Additional details regarding the hinge functionality are later discussed.

In practice, the precise curvature or shape, number, size, and mounting position of the panels can be varied. A desired aesthetic, mounting position and orientation of devices, as well as number and size of devices, can dictate the curvature, shape, number, size, and mounting position of a panel. For example, the present embodiment employs six directional cellular antennas 1001 and six cellular radios 1002 (see FIGS. 2A and B which show several); their relative size and equidistant spacing about backbone 3004 (e.g., to ensure integrity of the aforementioned "mesh") necessitates the relative size and position of each panel. That being said, if a sleek canister style is not aesthetically pleasing, each panel could take a different form (e.g., come together to form a box shape when affixed to ribs 3001-3003 at their respective mounting positions). Of course, one must balance any desired aesthetic against practical limitations in an elevated, outdoor environment. Mobile network installations such as that illustrated herein (see reference no. 100) could be exposed to winds on the order of 90 miles per hour (mph) or more under some conditions, and so there may be a benefit to shroud assembly 3000 taking on a canister shape or other shape known to reduce wind loading; i.e., a size or shape that is considered to have a low drag coefficient Cd (e.g., less than 1.0). Or, perhaps more broadly, one may consider mobile network installation 100 a part of the overall terrain—which makes a degree of sense insomuch that it is considered part of the aesthetic of the terrain. In this sense, the shroud assembly portion of mobile network installation 100 could be formed of a size or shape to aid in reducing shape factor k (e.g., less than 1.0) to minimize wind turbulence.

Each panel—regardless of size, curvature, etc.—works with the framework to provide a number of benefits: rigidity to withstand wind loads and provide a surface for aesthetic modification, structural integrity for supporting the mobile network devices in their aimed positions, in situ accessibility for a technician, and the ability to ensure radio frequencies (RF) signals are transmitted and received without interference regardless of any changes to the aiming of mobile network devices over time (details of which are presently discussed).

Figure 3C:
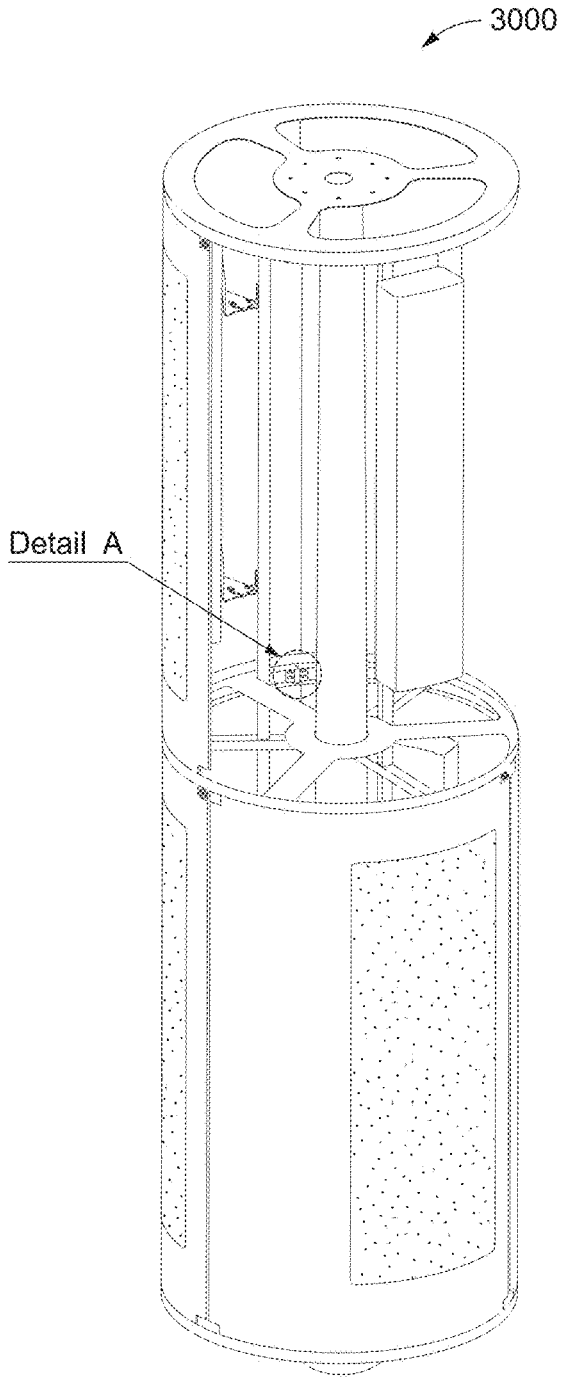
FIG. 3C illustrates a partially assembled view of the canister-shaped, multi-panel shroud and framework of FIG. 3A and including hinge functionality according to aspects of the present invention.
Figure 3D:
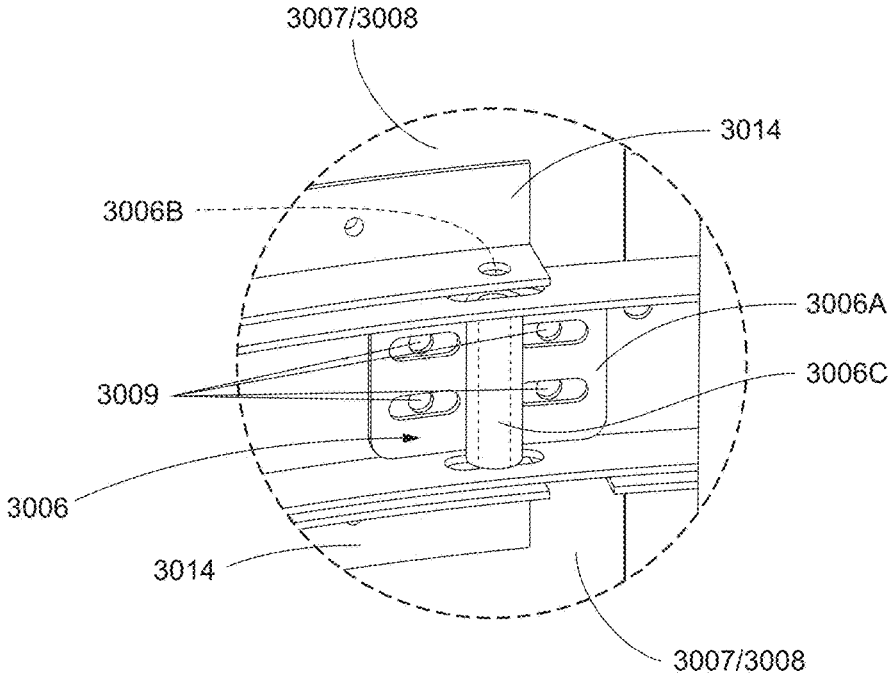
FIG. 3D illustrates Detail A of FIG. 3C.
Figure 3E:
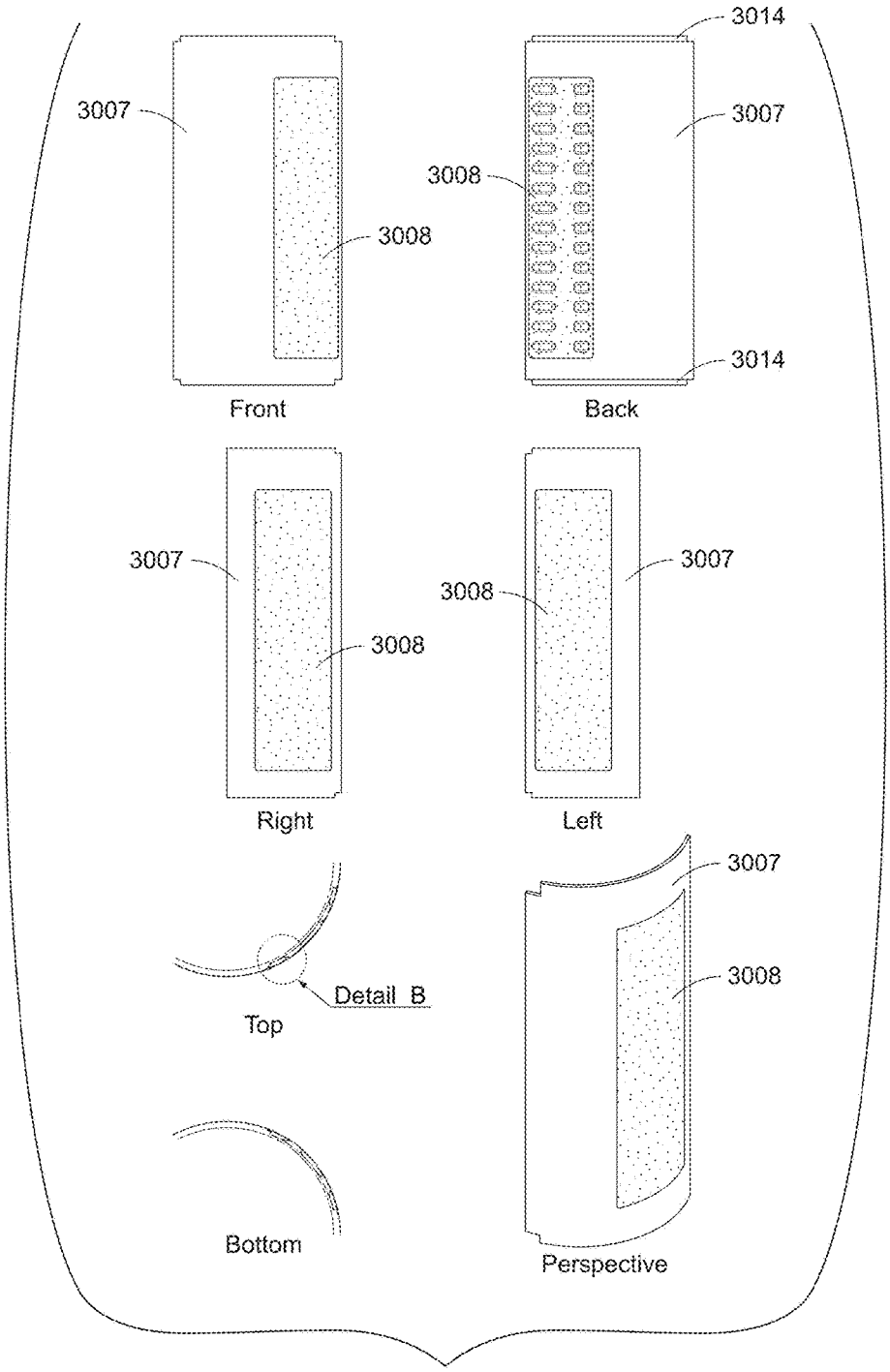
FIG. 3E illustrates in isolation various views of one panel of the shroud of FIGS. 3A-D with associated brace.
Figure 3F:
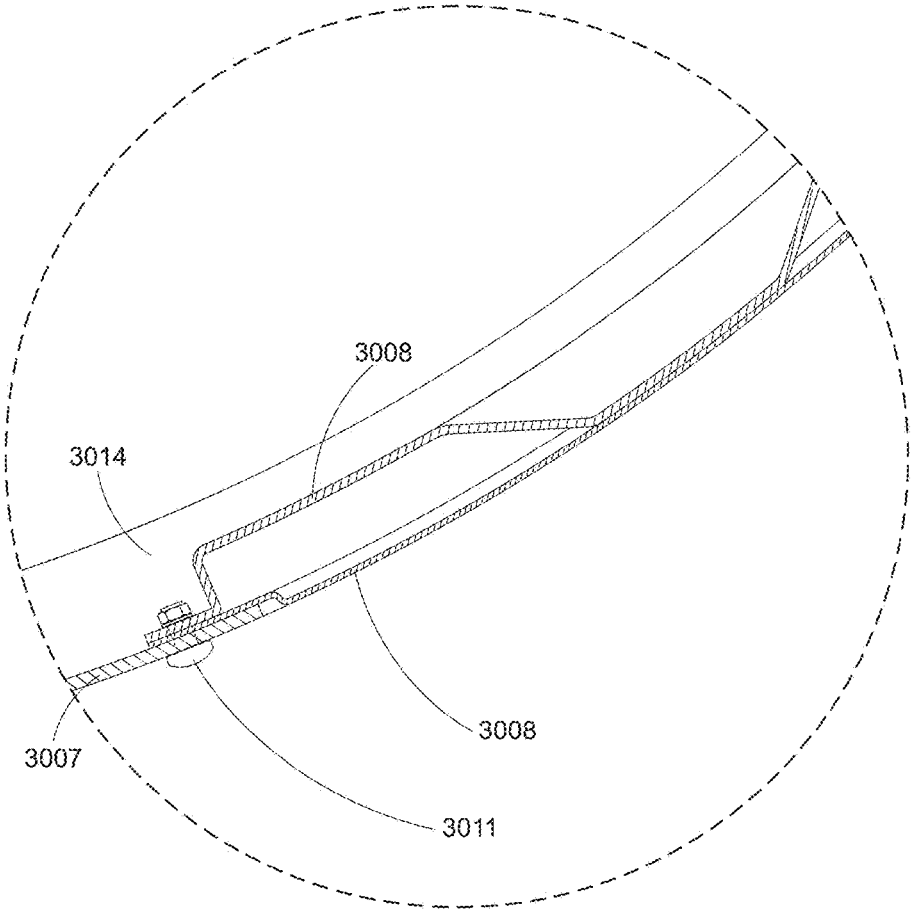
FIG. 3F illustrates Detail B of FIG. 3E.

FIGS. 3E and F illustrate in greater detail a single panel of shroud assembly 3000 according to the present embodiment. As can be seen, each panel includes a fiberglass frame 3007 with an RF-transmissive inlay 3008. Each panel can be thought of as a door with a selectively placed window, since each panel can be pivoted open via hinge assembly 3006 (FIG. 3D, later discussed) and each inlay 3008 is transparent for purposes of sending or receiving EM signals specific to the mobile network devices. In this embodiment, each inlay 3008 is on the order of 7 feet×3 feet to accommodate the spread of its associated mobile network devices (which is roughly 70 inches×12 inches×7 inches for some directional cellular antennas) at a canister diameter of 60 inches. Each inlay 3008 is actually formed from two sheets of RF-transmissive material (e.g., any of the Kydex® brand materials available from SEKISUI SPI, Bloomsburg, Pa., USA or StealthSkin™ brand materials available from Stealth Concealment Solutions, Inc., North Charleston, S.C., USA) which are thermoformed according to state-of-the-art practices; namely, heated until pliable, formed (possibly under vacuum), and sealed (e.g., via glue, bonding, or fusing). This is contrary to fiberglass frame 3007 which, according to at least some embodiments, is injection molded or chopped fiberglass sprayed on a mold according to state-of-the-art practices. Inlay 3008 is secured in its position in frame 3007 via state-of-the-art fiberglass fastening devices 3011 (FIG. 3F) so to prevent any signal interference, though other RF-transmissive fastening devices or methods (e.g., glue, silicone) could be used in lieu of fastening devices (e.g., if formed from sheet metal) that might otherwise interfere with a signal.

There is both flexibility and benefit in this approach to designing the shroud panels. RF-transmissive materials such as the aforementioned are traditionally sold as sheet material—easily modified (e.g., colored, textured, embossed, including indicia such text or graphics) to achieve an aesthetic, but relatively thin (e.g., from a fraction of an inch thick to a few inches thick), of limited size (at least using traditional forming methods such as the aforementioned), and non-rigid. Even with thermoforming to provide some rigidity (see "bumps" in the back view of FIG. 3E) these materials are not structurally sound at the wind speeds typically encountered at the top of an outdoor pole. Alternatively, most fiberglass materials are structurally sound, rigid and can be modified to some degree to achieve an aesthetic, but are not RF-transmissive to the degree demanded by most mobile network service providers insomuch that some signal transmissions (e.g., in the field of reliable mobile networking) must be so precise that even specially formulated fiberglass may scatter a signal (i.e., not transmit the signal intact as it passes through the material) to an unacceptable degree. So it can be seen that there may be a benefit to having an RF-transmissive window in the field of view of each mobile network device, but a material having greater structural integrity located elsewhere.

In practice, shroud assembly 3000 (and to a broader degree mobile network concealment assembly 1000) may be created and/or installed according to method 6000 of FIG. 5; though this is but one possible way to practice the invention. According to a first step 6001, the framework is assembled. In practice, step 6001 may include such things as determining an appropriate length of backbone 3004; for example, to achieve a desired aesthetic or to accommodate multiple stacks of radios or antennas. Step 6001 may also comprise determining the number of intermediate ribs 3003 between proximate rib 3002 and distal rib 3001, as well as the relative thickness of each; for example, to provide the desired rigidity for anticipated wind loading or to provide adequate space for holes 3009 (FIGS. 3B and D) to which a hinge assembly 3006 (FIG. 3D) can be bolted or otherwise affixed. Step 6001 may also comprise determining the diameter of ribs 3001-3003; for example, to provide the desired aesthetic or to ensure radios/antennas which are spaced about backbone 3004 are adequately shrouded.

A second step 6002 generally comprises mounting the mobile network devices to the framework. In practice, radios, antennas, or other devices could be pre-aimed (see for example, aforementioned U.S. patent application Ser. No. 15/260,464, now U.S. Pat. No. 10,199,712) and mounted to the framework at their pre-aimed orientations. Clamping devices (203, FIG. 2B) could be removably affixed to the framework. State-of-the-art mounting brackets or adjustable armatures (see for example, U.S. Pat. No. 8,337,058 incorporated by reference herein in its entirety) or some other apparatus for affixing mobile network devices relative the framework (regardless of whether said apparatus are removable or not) could be used. Step 6002 is generally considered complete when all components/devices desired to be located within the mobile network concealment assembly are installed relative the framework in a manner such that no mobile network component extends out past the diameter of ribs 3001-3003 (i.e., that the framework at least partially surrounds the mobile network components); see FIG. 2B.

According to a third step 6003 the shroud panels are created. Step 6003 generally comprises sizing and shaping each fiberglass frame in accordance with the framework and desired aesthetic, as well as sizing and shaping each RF-transmissive window in accordance with the relative position of mobile network devices, size and shape of mobile network devices, and characteristics of the signal. Conceptually, this process is illustrated in FIG. 4A-C. As can be seen from FIGS. 4A and B, a directional cellular antenna 1001 needs to "see" a signal over some angular spread 4000; if the shroud material is RF-transmissive (see reference no. 3008, FIG. 4A) the signal is transmitted with little to no disturbance, whereas if the shroud is not RF-transmissive or is insufficiently RF-transmissive (see reference no. 3007, FIG. 4B) the signal is scattered, deflected, diminished, or absorbed. Angular spread—and therefore the size of the RF-transmissive window—is determined by the particular mobile network device and mobile network service provider.

For example, most directional antennas can be pivoted in the horizontal plane; see FIG. 4C which illustrates (from a top view) a directional antenna 1001 pivoted right (1001A) and left (1001B). Physical or mechanical pivoting in the vertical plane is not typically needed as this is usually achieved by filtering or tuning the signal by the technician or mobile network service provider. Said directional antenna will typically have a primary beam angle—sometimes referred to as the half-power angle—which is generally defined as the angular spread needed to encompass all signals having at least 50% the strength of a maximum signal strength at the desired (and often proprietary) frequency range. How far recessed within shroud assembly 3000 a directional antenna is mounted (see distance L, FIG. 4C), in addition to the desired pivot in the horizontal plane, will modify the primary beam angle (see angle a, FIG. 4C)—and RF-transmissive window 3008 may be sized accordingly. As a specific example, a directional cellular antenna having rough dimensions of 6 feet×1 feet (ignoring any thickness) which can be pivoted ±25° (i.e., pivoted left or right 25°), and having a horizontal primary beam angle of 65°, may be set back 1.5 inches from window 3008. According to step 6003 and well known mathematical principles, an RF-transmissive window on the order of 3 feet×7 feet would ensure that the antenna only "sees" RF-transmissive materials over its primary beam angle regardless of pivoting. Though unlikely, if the cellular antenna was also pivotable in the vertical plane (i.e., could be pivoted up or down in situ), the same logic could apply to arrive at a final window size that would ensure the window always covered the primary beam angle regardless of pivoting (in either plane).

Once designed, RF-transmissive window 3008 could be inserted into its recess in fiberglass frame 3007 (see FIG. 3F) and secured with fastening devices 3011 (or otherwise). Step 6003 may also comprise securing brace 3014 (FIG. 7) to the assembled panel. According to the present embodiment, brace 3014 comprises apertures on a tabbed section 3014C which abuts the exterior perimeter of the ribs so to permit the threading of a removable self-retained fastening device; here, a screw 3012A and captive nut 3012B which is illustrated in exploded view for a single screw/nut combination in FIG. 3B, and as assembled in FIGS. 3A and C; note that in practice the captive component (e.g., nut 3012B) is bolted or affixed to some portion of the backbone (e.g., upper rib 3001). Self-retained fastening devices ensure that when a technician removes them in situ (e.g., so to permit the panel to pivotably open via hinge assembly 3006, FIGS. 3C and D), fastening devices do not fall to the ground from the elevated position. Brace 3014 further comprises an aperture section 3014D generally opposite tabbed section 3014C along the curvature of brace sections 3014A and B; where section 3014B provides rigidity, section 3014A provides a surface for affixing the panel to the brace (e.g., via fastening devices 3011 through apertures shown in part 3014A), and the curvature of brace 3014 matches that of the desired shape of the shroud assembly. The aperture of section 3014D is designed to receive a hinge pin 3006B (FIG. 3D) which forms a part of hinge assembly 3006; note that for clarity, FIG. 3D has omitted all fastening devices. Hinge assembly 3006 further comprises a hinge plate 3006A which is affixed to the ribs via fastening devices through apertures 3009 (see also FIG. 3B which illustrates one set of apertures), as well as a hinge pin retainer 3006C. In practice, step 6003 may only include the assembly of some of the aforementioned; some fastening may need to be done on site by a technician in accordance with step 6004.

According to a fourth step 6004 shroud assembly 3000 is installed. As has been stated, shroud panels 3007/3008 are placed about and affixed to the framework so to shroud, encase, or otherwise cover the mobile network devices affixed to the framework. Therefore, it stands to reason that the framework with the pre-aimed devices affixed thereto is positioned first according to step 6004. Though it will likely differ from technician to technician and from site to site, step 6004 may be similar to the following:

- a technician is elevated
- the technician affixes the framework with pre-aimed mobile network devices to the distalmost pole section 103
- if not already completed, the technician secures shroud panels to the framework (e.g., via hinge assembly 3006)—see FIG. 3C for a partially assembled shroud assembly
- the technician services, initiates, commissions, or otherwise verifies correct operation of the mobile network equipment
- the technician pivots shut or otherwise closes the shroud assembly, and secures it in a closed position (e.g., via fastening devices 3012 in tabbed section 3014C)
- the technician is lowered According to step 6005 the mobile network concealment assembly is finalized (i.e., fully installed). Step 6005 may comprise such things as adding indicia, color, or other features to the shroud assembly so to achieve a desired aesthetic, or connecting all electrical wiring from the mobile network devices located at the top of a pole to components that are ground mounted or enclosure mounted (e.g., the aforementioned base station transceivers). As previously stated, if the pole is substantially hollow, wiring could be internally routed so to (i) provide a degree of protection against adverse weather conditions (e.g., moisture, UV exposure) and (ii) aid in preserving or achieving some aesthetic. Alternatively, similar materials to those of frame 3007 and window 3008 may be added according to step 6005 to conceal said wiring down the length of the pole or other elevating structure.

Lastly, according to step 6006 mobile network installation 100 may be finalized (i.e., fully installed). Step 6006 may comprise adding components (e.g., lighting rod 1003) required to fulfill some functional need, or additional mobile network devices (e.g., microwave devices 200) which are not shrouded, completing all electrical wiring not already finalized (e.g., wiring for sensor or wireless control of other devices on the pole (e.g., lighting fixtures)), or final commissioning of devices, for example.

C. Exemplary Method and Apparatus Embodiment 2

An alternative embodiment in accordance with at least one aspect of the present invention envisions a rubber boot 3010 in lieu of the RF-transmissive window 3008 of Embodiment 1. As can be seen from FIG. 6A-C directional antenna 1001 (or other mobile network device) is not entirely shrouded; rather, it has a direct line-of-sight in any of a number of aiming directions (i.e., does not have any material (RF-transmissive or otherwise) between the device and a signal). In practice, the shroud panel of FIG. 6B would be constructed in much of the same manner as that of FIG. 3E, and the method of FIG. 5 substantially the same; the primary difference is illustrated in View C-C of FIG. 6C. As can be seen, rubber boot 3010 is secured to both antenna 1001 and fiberglass frame 3007 using fiberglass or other RF-transmissive fastening devices 3011. The rubber boot is removable, yet provides a seal so to shield any internal components of shroud assembly 3000 from adverse weather conditions, prevent birds from nesting inside shroud assembly 3000, and the like. If it is impractical to directly bolt to antenna 1001 (or other mobile network device), a fiberglass chassis could be placed around the perimeter of the mobile network device and the fiberglass fastening device affixed thereto. Alternatively, glue, tape, or other fastening apparatus could be used. Rubber boot 3010 could even be formed so to have an aperture slightly smaller than the dimensions of the associated mobile network device such that the boot could be stretched around the perimeter of the device and provide a sealing fit (i.e., provide an interference-type fit). This particular approach would potentially accommodate a wider range of aiming angles (without impeding signals) than that of Embodiment 1, but would be more or less constrained to the mobile network device for which it was designed—and therefore, would have less flexibility in being sized up or down in situ or rotated about the backbone as compared to Embodiment 1.

D. Options and Alternatives

The invention may take many forms and embodiments. The foregoing examples are but a few of those. To give some sense of some options and alternatives, a few examples are given below.

As discussed and illustrated herein, RF-transmissive fastening devices have comprised a combination of self-retained threaded fiberglass screw with a complementary threaded nut; this is by way of example and not by limitation. Glue, tape, welds, and other fastening apparatus and methods—whether removable or not—could be used and not depart from at least some aspects according to the present invention. Likewise, a number of mobile network devices has been discussed and illustrated herein; these too are by way of example and not by way of limitation. Aspects according to the present invention could be applied to any number, design, or combination of mobile network devices (or other devices or components) operating at any frequency and in any configuration on an elevating structure. There may even be situations where certain fastening devices need not be RF-transmissive (e.g., due to not being in the signal path), and therefore may be formed from more traditional materials (e.g., sheet metal, brass)—which may be more cost effective. Alternatively, if the devices are not operating on a radio frequency, but are using some other form of EM signal, fastening devices might not be commercially available at all and therefore may need to be made custom. Regardless, fastening devices could be removable or permanent, RF-transmissive or not; some additional non-limiting examples are screws, clamps, and snap-in connectors.

Regarding further options and alternatives, while there have been stated benefits to using an elevating structure that is substantially hollow (such as pole or pole sections 103), other elevating structures (e.g., open truss systems) could be used and not depart from at least some aspects according to the present invention. Further, as previously discussed, the encasement, shroud, or aesthetic/protective cover—as it has been referred to herein—can, in at least some situations, be formed so to reduce wind loading. There are a number of approaches in the state of the art of aeronautics, fluid dynamics, civil engineering, and like which could be consulted in creating a mobile network installation which provides a desired aesthetic and a desirable shape for wind loading in the same design; some non-limiting examples are illustrated in U.S. Patent Applications Nos. 29/530,839 and 29/530,844, both of which are incorporated by reference herein in their entirety, respectively. Also as previously discussed, various apparatus and methods may be used to affix the mobile network devices (e.g., reference nos. 200, 1001, 1002) to the framework. One particular example already discussed is one in which supports 3005 (FIG. 2B) are clamped to spokes 3006 instead of welded to backbone 3004. This could place mobile network devices closer to the RF-transmissive window within shroud assembly 3000, which could impact how much RF-transmissive material is needed for a given application—and is one consideration in the design of each panel of shroud assembly 3000.

Lastly, each panel can not only be removed and replaced with a different panel (e.g., to accommodate different mobile network devices), but rotated about backbone 3004. This could be achieved by pivoting ribs/spokes about backbone 3004 with mobile network devices already affixed thereto (assuming spokes 3006 are not permanently affixed at their initial position), or otherwise. In this manner, a technician can adjust the position of each panel in shroud assembly 3000 to accommodate changes to the mobile network over time without impacting functionality, and without disturbing the aesthetic. But it should be noted that aesthetics can also be the driving force in changing a panel. A panel colored blue could be switched out for a panel colored green during certain times of the year, or three panels having 120° curvature could be switched out for six panels having 60° curvature so to, in essence, double the real estate space for indicia or advertising—as two non-limiting examples.

What is claimed is:

1. A shroud for accessing one or more elevated electrically powered mobile network components each of which transmits and/or receives signals comprising:

a. a rigid framework at least partially surrounding the elevated mobile network components and having an opening for each of the one or more elevated mobile network components;

b. a panel at each opening in the framework and formed from a material which transmits said signals; and c. a hinge assembly affixing each panel to the framework at each opening such that each panel may be pivoted away from the framework and allow access to the one or more elevated electrically powered mobile network components.

2. The shroud of claim 1 wherein the signal comprises an electromagnetic signal at radio frequency (RF).

3. The shroud of claim 1 wherein the rigid framework further comprises a hollow backbone and wherein wiring to power said mobile network components is routed into the hollow backbone from the elevated position.

4. A method of concealing one or more elevated mobile network components each of which transmits and/or receives signals without deflecting, diminishing, or absorbing the signals comprising:

a. assembling a framework;

b. mounting the one or more mobile network components to the framework in a manner such that:

i. the framework at least partially surrounds the one or more mobile network components; and ii. no mobile network component extends out past a boundary of the framework;

c. creating a plurality of panels each having at least a portion which passes the signals;

d. mounting the plurality of panels to the framework in a manner which:

i. at least substantially conceals the one or more mobile network components;

ii. aligns the portion of each panel with a signal pathway to or from each of the mobile network components; and iii. allows access to one or more of the mobile network components while a part of the panel remains attached to the framework or another panel.

5. The method of claim 4 wherein the framework is mounted at least thirty feet above the ground or floor on a pole or a truss.

6. The method of claim 4 wherein the mobile network components are one of:

a. directional; and b. omnidirectional.

7. The method of claim 4 wherein the mobile network components comprise one or more of:

a. antennas;

b. radios;

c. transmitters;

d. receivers;

e. transceivers; and f. filters.

8. The method of claim 4 further comprising:

a. connecting wiring to at least some of the mobile network components.

9. The method of claim 4 further comprising one or more of:

a. coloring at least a portion of the panels;

b. adding text or graphics to at least a portion of the panels; and c. texturing at least a portion of the panels.

10. A system for shrouding mobile network components comprising:

a. a pole;

b. a framework mounted on the pole;

c. mobile network components mounted to the framework said mobile network components having an angle over which signals are received and/or transmitted;

d. plural panels mounted to the framework each panel having an aperture sized at least to cover said angle;

e. plural flexible boots each boot affixed to a panel proximate the aperture of the panel; and f. one or more fastening devices or methods to affix the mobile network components to the boots such that a flexible interface is made between the panels and the mobile network components thereby permitting adjustment of the mobile network components over said angle.

11. The system of claim 10 wherein the framework comprises:

a. a backbone;

b. plural ribs along the backbone; and c. wherein at least one of the framework, backbone, and ribs is adjustable relative the pole to adjust the panels relative to the mobile network components.

12. The shroud of claim 1 wherein a portion each panel comprises RF-transmissive material and the remainder of the panel is a frame of the portion comprising fiberglass material.

13. The shroud of claim 1 wherein one or more panels is:

a. colored;

b. textured; and/or c. marked with indicia such as text or graphics.

14. The system of claim 10 wherein the mobile network components are mounted to the framework at pre-aimed orientations.

15. The system of claim 10 wherein the pole comprises a pre-existing elevating structure with non-mobile network components affixed thereto and the remainder of the system is retrofitted to said pole.

* * * * *